US012661572B1

(12) United States Patent
Zeleznick

(10) Patent No.: US 12,661,572 B1
(45) Date of Patent: Jun. 23, 2026

(54) SNOW DISPLACEMENT APPARATUSES

(71) Applicant: Luke Zeleznick, Eden, UT (US)

(72) Inventor: Luke Zeleznick, Eden, UT (US)

( * ) Notice: Subject to any disclaimer, the term of this patent is extended or adjusted under 35 U.S.C. 154(b) by 267 days.

(21) Appl. No.: 18/634,270

(22) Filed: Apr. 12, 2024

(51) Int. Cl.
*A63C 5/06* (2006.01)

(52) U.S. Cl.
CPC ..... *A63C 5/06* (2013.01)

(58) Field of Classification Search
CPC .. A63C 5/00; A63C 5/06; A63C 5/061; A63C 5/062
See application file for complete search history.

(56) References Cited

U.S. PATENT DOCUMENTS 3,867,773 A * 2/1975 Gunderson ..... E01H 5/045 406/161
4,106,787 A * 8/1978 Thon ..... A63C 5/065 280/817
4,131,291 A * 12/1978 Thon ..... A63C 5/065 280/817
4,456,158 A * 6/1984 Wertz ..... B60R 9/12 224/323
4,798,933 A * 1/1989 Annovi ..... A43B 3/355 36/2.6
4,986,561 A * 1/1991 Humphrey ..... A63C 11/00 280/809
5,104,140 A * 4/1992 Anderson ..... A63C 5/0422 280/608
5,551,728 A * 9/1996 Barthel ..... A63C 5/03 280/14.1
6,308,979 B1 * 10/2001 Ludlow ..... A63C 7/1026 280/620
6,499,238 B2 * 12/2002 Kluck ..... E01H 5/045 37/261
8,733,773 B2 * 5/2014 Sampson ..... B62K 19/22 280/190
9,108,103 B2 * 8/2015 Nobil ..... A63C 11/20
9,132,336 B2 * 9/2015 Bulan ..... A63C 5/031
11,492,769 B2 * 11/2022 Toews ..... A63C 5/06
2007/0126203 A1 * 6/2007 Giffin ..... A63C 9/02 280/615
2009/0081910 A1 * 3/2009 Starr ..... B63B 32/35 441/79
2013/0229006 A1 * 9/2013 Nobil ..... A63C 11/20 280/809

(Continued)

FOREIGN PATENT DOCUMENTS

CN 120854640 A * 10/2025 ..... A63C 5/06
EP 0933102 A2 * 8/1999 ..... A63C 11/026

(Continued)

*Primary Examiner* — Jason C Smith
(74) *Attorney, Agent, or Firm* — Miller IP; Devin Miller

(57) ABSTRACT

Described herein are examples of methods which include mounting a deflector onto a top surface of a ski or snowboard. A first point of the deflector may be pivotally connected to the ski via a mounting component, and a second point of the deflector is in contact with the top surface of the ski. The method may also include coupling a first fastening component to the first point of the deflector and the mounting component and adjusting the angle of the deflector relative to the top surface of the ski by rotating the deflector to a desired angle. The method may further include locking the deflector at the desired angle using a locking component.

20 Claims, 5 Drawing Sheets

(56) References Cited

U.S. PATENT DOCUMENTS

| | | | | |
|---|---|---|---|---|
| 2015/0238843 | A1* | 8/2015 | Allenspach | A63C 10/18<br>280/613 |
| 2015/0290526 | A1* | 10/2015 | Nobil | A63C 11/20<br>280/809 |
| 2016/0107060 | A1* | 4/2016 | Elias | A63B 69/18<br>434/253 |
| 2024/0293727 | A1* | 9/2024 | LaForge | B24B 55/02 |

FOREIGN PATENT DOCUMENTS

| | | | | |
|---|---|---|---|---|
| EP | 2082787 | B1 | 7/2009 | |
| EP | 2324892 | B1 | 5/2011 | |
| FR | 2617729 | A1 * | 1/1989 | A63C 5/052 |
| JP | 2020182749 | A * | 11/2020 | |

* cited by examiner

SNOW DISPLACEMENT APPARATUSES

BACKGROUND

In the realm of outdoor recreation, skiing and snowboarding are popular activities that attracts enthusiasts to snowy slopes and mountainous areas worldwide. Skiers glide down snow-covered hills using specialized equipment like skis, boots, and poles for balance and propulsion. Within the skiing community, there's a growing interest in ski accessories and attachments aimed at enhancing the skiing experience. These attachments may be used for various purposes, such as improving performance, safety, and enjoyment on the slopes. They provide features for different skiing conditions, such as powder snow or groomed trails, are designed to meet diverse needs and preferences of skiers, and ultimately make skiing more enjoyable and satisfying.

BRIEF DESCRIPTION OF THE DRAWINGS

The present description will be understood more fully when viewed in conjunction with the accompanying drawings of various examples of snow displacement apparatuses. The description is not meant to limit the snow displacement apparatus to the specific examples. Rather, the specific examples depicted and described are provided for explanation and understanding of snow displacement apparatuses. Throughout the description the drawings may be referred to as drawings, FIGURES, and/or FIGS.

DETAILED DESCRIPTION

A snow displacement apparatus as disclosed herein will become better understood through a review of the following detailed description in conjunction with the figures. The detailed description and figures provide merely examples of the various embodiments of snow displacement apparatuses. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional ski attachment may include basic designs such as straps or clips for securing additional gear to the skis. These attachments are primarily used for carrying items like poles or avalanche safety equipment and are not specifically engineered to improve skiing performance. While functional for their intended purpose, they lack features aimed at enhancing the skiing experience, particularly in terms of creating visually appealing effects or improving skiing maneuvers.

Identifying problems and opportunities with the current state of ski attachments reveals several limitations. Conventional attachments may not effectively capture the excitement of skiing in powder snow conditions, failing to produce visually captivating effects such as clouds of snow or "rooster tails." Moreover, they may not offer sufficient stability or adjustability, leading to potential inconvenience or safety hazards for skiers. Additionally, these attachments may not provide versatility to adapt to different skiing environments or preferences.

Implementations of ski attachments may address some or all of the problems described above. A ski attachment with features, such as an adjustable deflective or aerodynamic design, could enhance snow deflecting efficiency while reducing drag during skiing maneuvers. Furthermore, incorporating durable yet lightweight materials could improve durability without compromising performance. Additionally, offering adjustable components or customizable options would provide versatility to cater to various skiing styles and conditions.

The disclosed embodiments address problems and opportunities by introducing various features for enhancing the skiing experience. For instance, adjustable components allow skiers to customize the attachment according to snow conditions or personal preferences, which may improve overall performance and enjoyment. Moreover, the use of certain materials provides durability and lightweight construction and enhances maneuverability and efficiency on the slopes. Overall, the disclosed embodiments aim to elevate the skiing experience by combining functionality with aesthetics and versatility.

Figure 1:
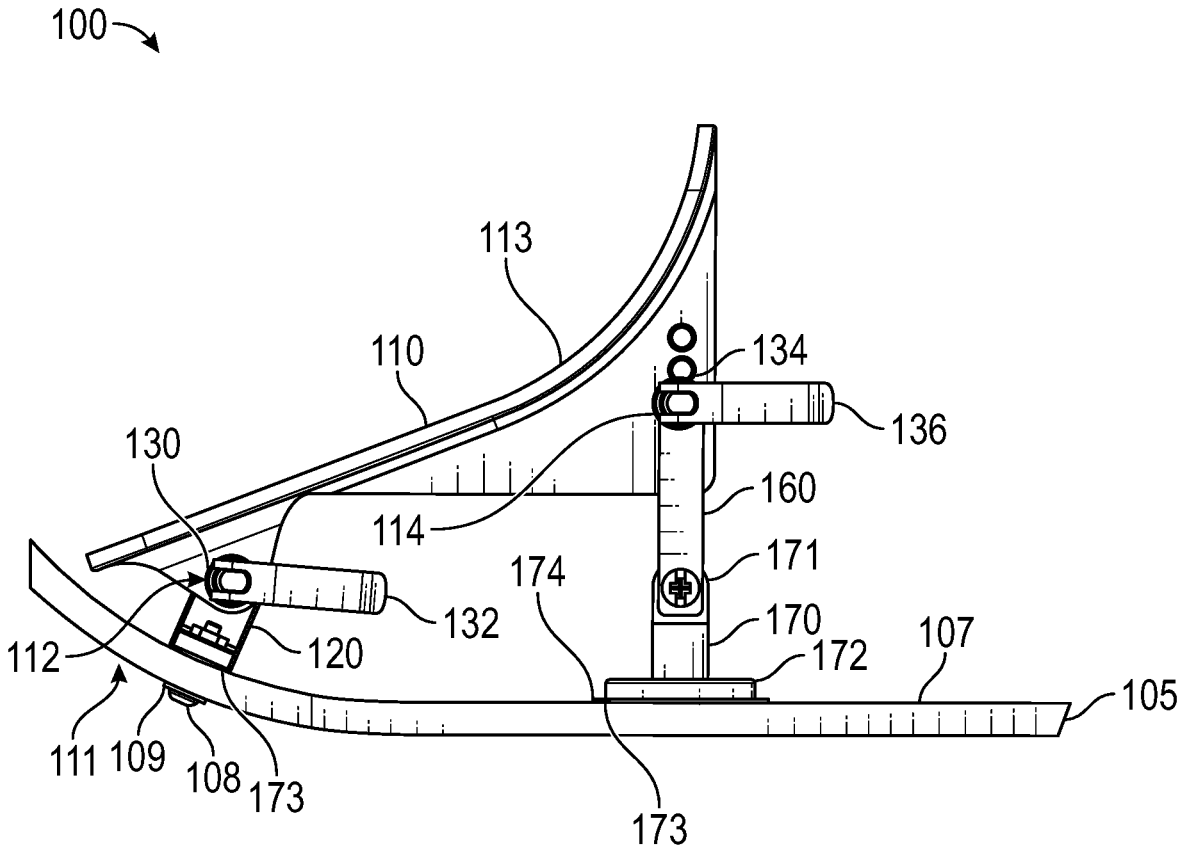
FIG. 1 is a side view of a snow displacement apparatus, according to an embodiment.

FIG. 1 is a side view of a snow displacement apparatus 100, according to an embodiment. The snow displacement apparatus 100 may be used to enhance the experience for skiers by creating captivating visual effects, such as snow clouds or "rooster tails," while simultaneously mitigating drag for the skier and contributing to an enjoyable and visually stunning skiing experience. As the skier maneuvers, snow flows onto a deflector 110 and it is configured to displace the snow upwards in front and possibly behind the skier. This may enhance the skiing experience and may be suitable for capturing aesthetically pleasing photographs. While the snow displacement apparatus 100 is primarily described in the context of its application on a ski, it is not limited to that specific use. It can also be employed on a snowboard or any other moving object in the snow.

A first point 112 of the deflector 110 may be pivotally connected to a top surface 107 of a ski 105 through a mounting component 120. The mounting component 120 may be attached to the top surface 107 of the ski 105 via a fastening component 108. The fastening component 108 may be inserted from the bottom of the ski 105 and upwards into the mounting component 120. For example, the fastening component 108 may include a socket button head cap screw (#10-32×0.875 Stainless Steel). However, the fastening component 108 may include any suitable fastening component. Additionally, a washer 109 may be inserted between the head of the fastening component 108 (e.g., screw) and the bottom surface of the ski 105. The washer 109 may evenly distribute pressure between the head of the fastening component 108 (such as a screw) and the bottom surface of the ski 105. This may prevent damage to the ski surface and may provide a secure fastening without causing deformation or uneven stress concentration.

In one embodiment, the mounting component 120 may be positioned before a tip 111 of the ski 105 curves adjacent to it, on the substantially flat portion of the ski 105, such that the fastening component 108 is flush with the substantially flat portion of the bottom of the ski 105. Meanwhile, a second point 114 of the deflector 110 may make contact with the top surface 107 of the ski 105. Additionally, the snow displacement apparatus 100 may include a detachable fastener 130, serving as a first fastening component, for detachably and rotatably coupling the first point 112 of the deflector 110 to the mounting component 120 to enable skiers to adjust the angle of the deflector 110 relative to the ski's top surface 107 as desired. The angle of the deflector 110 relative to the top surface 107 of the ski 105 may be any suitable angle, but it is preferable for it to be between 30 and 70 degrees. The deflector 110 can be easily removed from the mounting bracket 120 when skiing conditions do not involve powder snow or simply when the skier does not want it to remain on the ski 105.

The deflector 110 may include a curved front surface 113 facing the snow in front of the ski 105 when the deflector 110 is mounted onto the ski 105. When skiing through powder snow, the curved shape of the deflector 110 may enable it to efficiently deflect or scoop and displace a greater amount of snow upward and outward as the skier moves. This movement may generate visually striking clouds of powder, often referred to as "face shots" or "rooster tails," either in front of or behind the skier, thereby enhancing the overall skiing experience and adding aesthetic appeal to skiing photographs. In an embodiment, the curved surface 113 may include a J-shaped contour. The J-shaped contour of the ski may be particularly beneficial for propelling a larger amount of snow while simultaneously reducing drag for the skier by minimizing resistance against the snow it encounters. As the ski's curved tip slices through the snow, it may experience less friction compared to a deflector with a flat or less aerodynamic profile. This reduction in friction may lessen the effort required for the skier to maneuver through the snow, resulting in smoother and more effortless skiing. Additionally, the upward displacement of snow by the J-shaped contour of the deflector 110 may help maintain the ski's buoyancy on the snow surface, further reducing the possibility of drag or deceleration. The J-shaped contour of the deflector might apply a gentle downward force on the ski, helping it sink deeper into the snow and gather more snow onto the scoop. However, this force may be minimal, such that it doesn't have a negative impact on performance.

The first contact point 112 of the deflector 110 may be connected to the top surface 107 of the ski 105 via the mounting component 120. In an embodiment shown in this figure, the mounting component 120 may be affixed or fixedly coupled to the top surface 107 of the ski 105 at or near the tip 111 of the ski 105 via the detachable fastener 130. The detachable fastener 130 may include a screw, bolt, or similar apparatus. An end of the deflector 110 may include a complementary shape configured to attach, fit, or engage with the mounting component 120. For example, in the embodiment depicted in this figure, the end of the deflector 110 may be H-shaped and may engage with the complementary-shaped mounting bracket 120, aligning the openings of the H-shaped end with the openings of the mounting component 120. The detachable fastener 130 may be inserted through the openings of the H-shaped end of the deflector 110 and the openings of the mounting component 120 to securely couple the first end of the deflector 110 to the mounting component 120 at the front of the ski 105. In another embodiment, the deflector 110 may be fixedly or rotatably coupled to the mounting component 120. For instance, the deflector 110 may be secured to the mounting component 120 using adhesive, straps, or clamps, providing flexibility in attachment methods depending on the user's preference and skiing requirements. In yet another embodiment, the deflector 110 may be hingedly connected to the mounting component 120 to allow for rotational movement to adjust the angle of the deflector 110 relative to the ski's top surface 107.

In an embodiment, the deflector 110 may be made from a flexible, bendable, or pliable material and may be configured to maintain its shape until bent again, allowing a skier to adjust the curvature or contour of the deflector 110 by bending or molding it to a desired shape. This flexibility can be beneficial for adjusting the launch angle or deflection angle of snow. The flexible material may include polypropylene or polyethylene, but other suitable materials may also be used. Additionally, the deflector 110 may be constructed from a variety of materials, including those resilient enough to withstand cold conditions, such as plastic, silicone, rubber, glass, metal, or other suitable materials. It must possess enough solidity and rigidity to effectively propel snow. Environmentally friendly alternatives like hemp plastic, which is biodegradable, may also be utilized. Materials like bamboo, recycled plastic, or natural fibers such as jute or hemp may provide sustainability benefits while still providing the necessary durability for snow launching.

In an embodiment, the detachable fastener 130 may include a cam lock 132 configured to connect the first point 112 of the deflector 110 to the mounting component 120, thereby enabling the adjustment of the angle of the deflector 110 relative to the ski's top surface 107. Similarly, a second detachable fastener 134 may include a cam lock 136 for coupling the second point 114 of the deflector 110 to a mounting component 160, where the mounting component 160 may be connected to a magnetic mount 170. In an embodiment, the mounting component 160 may be connected to the magnetic mount 170 via a fastening component 171, such as a 316 stainless steel binding barrel screw. In another embodiment, the mounting component 160 and magnetic mount 170 may be integrally coupled as a single component. For example, the mounting component 160 may include a magnetic plate or magnetic mounting plate, but it may also include other suitable mounting components. The magnetic mount 170 may consist of a magnet 172 at its base that magnetically attaches to a magnetic plate 174 mounted on the ski's top surface 107, or a metal plate built into the ski. The utilization of cam locks at both the first and second points 112, 114 of the deflector 110, which correspond to the front and rear of the snow displacement apparatus 100 in this embodiment, enables the user to adjust the tightness or security of both the front and rear of the deflector 110 relative to the ski 105. This may ensure that the snow displacement apparatus 100 does not rattle or move during intense ski maneuvers with strong forces acting on it, thereby stabilizing the snow displacement apparatus 100 and maintaining the angle of the deflector 110 relative to the ski's top surface 107. Alternatively, in another embodiment, only a cam lock at the front or rear may be utilized, not both. Moreover, an alternative to a cam lock, such as a lever latch or a toggle clamp, could be used to attach the deflector 110 to the mounting component 120 or ski 105.

Dual-sided tape 173, such as foam adhesive tape, may be inserted between the ski's top surface 107 and the mounting component 120 and magnet 172 to provide a strong and secure bond between the mounting components and the ski surface 107. This bond may prevent shifting or detachment during use. Secondly, the dual-sided tape 173 may provide cushioning properties and distribute pressure evenly across the ski surface, and conforms to uneven ski surfaces. This cushioning effect helps to prevent damage to the ski and ensures a secure attachment without causing deformation or stress concentration. Additionally, the dual-sided tape 173 may act as a sealant by protecting against moisture or debris infiltration between the ski surface 107 and the mounting component 120 or magnet 170, which in turn may protect against corrosion and environmental damage.

Figure 2:
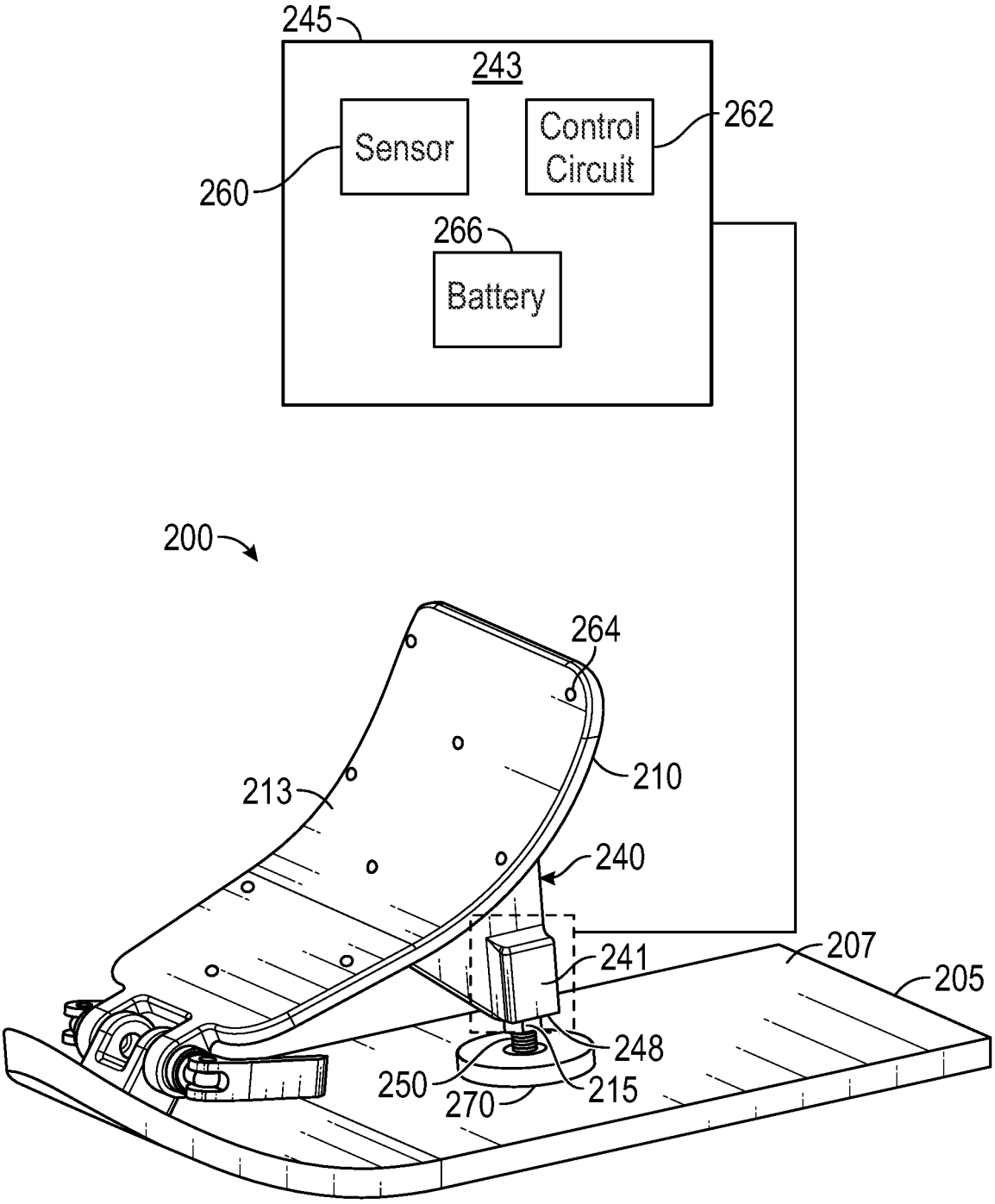
FIG. 2 is a perspective of a snow displacement apparatus, according to an embodiment.

FIG. 2 is a perspective view of a snow displacement apparatus 200, according to an embodiment. In this illustration, a support structure or component 240 extends from the rear or back of a deflector 210 towards a top surface 207 of a ski 205. The support component 240 is polygonal-shaped and positioned or oriented towards a rear of the deflector 210, along with a bottom side 248 at a bottom end of the support component 240. At the bottom end 248 and at the junction where the sides meet, there is a thick portion 241 with a hole for a screw 250 or another fastening component to extend downwards to the top surface 207 of the ski 205. The thick portion 241 may be shaped like a rectangular prism in one embodiment but can take any suitable shape, provided its diameter is wide enough to accommodate a hole for securing the support component 240 to the top surface 207 of the ski 205. Additionally, a nut 215 may be inserted between the bottom end of the deflector 210 and a magnetic mount 270 when the fastening component is a bolt, allowing for the height of the rear end of the deflector 210 to be adjusted up or down accordingly.

In an embodiment, the thick portion 241 may be shaped or configured in the form of a housing 243. The housing 243 may include a cavity 245 for housing various components. For instance, the housing 243 may include a sensor 260 configured to detect ski maneuvers. The sensor 260 may include an accelerometer, gyroscope, magnetometer, pressure sensor, strain gauge, optical sensor, and the like. The housing 243 may also include a control circuit 262 configured to operably control one or more heating elements 264. In an embodiment, the one or more heating elements 264 may be integrated within the deflector 210, with the heating elements 264 configured to apply heat to the curved front surface 213 of the deflector 210 in response to an input signal sent from the sensor 260 to the control circuit 262. Additionally, the housing 243 may contain a battery 266 to power the components, including the one or more heating elements 264. The deflector 210 may have integrated heating elements 264 positioned within it, along its sides, or integrated within cavities on the curved front surface 213 but flush with the surface. In this configuration, the heating elements 264 may conform to the curvature of the deflector 210 to ensure that snow is not impeded and is efficiently deflected or scooped up during skiing maneuvers. The heating elements may be activated by the control circuit 262 in response to the sensor 260 detecting skiing maneuvers by heating the deflector's curved front surface 213 to prevent snow buildup and enhance snow deflection or scooping efficiency, particularly in cold weather conditions, or wet sticky snow conditions. In another embodiment, the control circuit and battery 266 may be implemented as separate units or integrated within the ski 205.

In an embodiment where heating elements are integrated or otherwise used with the deflector 210, the construction of the deflector 210 may utilize various lightweight materials that are resistant to the effects of heating elements. These materials include carbon fiber, fiberglass, ceramic composites, and heat-resistant plastics.

In another embodiment, an actuator may be configured to adjust the position of the deflector 210 based on commands or signals received from the control circuit 262. For example, the actuator may be a linear actuator for linear movement or a rotary actuator for rotational movement, depending on the desired motion of the deflector 210. The control circuit 262 may detect various environmental conditions and calculate an angle for the deflector 210 to effectively displace snow. It may dynamically adjust the rotation or angle in response to a skier's maneuvers. The angle adjustment process may include receiving input signals from the control circuit 262, which analyzes data from various sensors to determine the current skiing conditions and the optimal angle for snow displacement. Based on this analysis, the control circuit 262 may calculate the necessary adjustment to the angle of the deflector 210. Linear movement may use commands to extend or retract the linear actuator, altering the position of the deflector 210 relative to the ski surface, while rotational movement may involve instructing the rotary actuator to rotate the deflector 210 forward or backward to adjust its orientation for optimal snow displacement.

In another embodiment, a transmitter or receiver may be integrated within the deflector 210, and may incorporate a tracking or locating device. This device could be communicatively linked to an external device, such as a mobile phone, to aid in locating a ski that has been lost in the snow. The tracking device could potentially connect to a mobile application on a phone or another separate device and include a GPS tracking feature.

Figure 3:
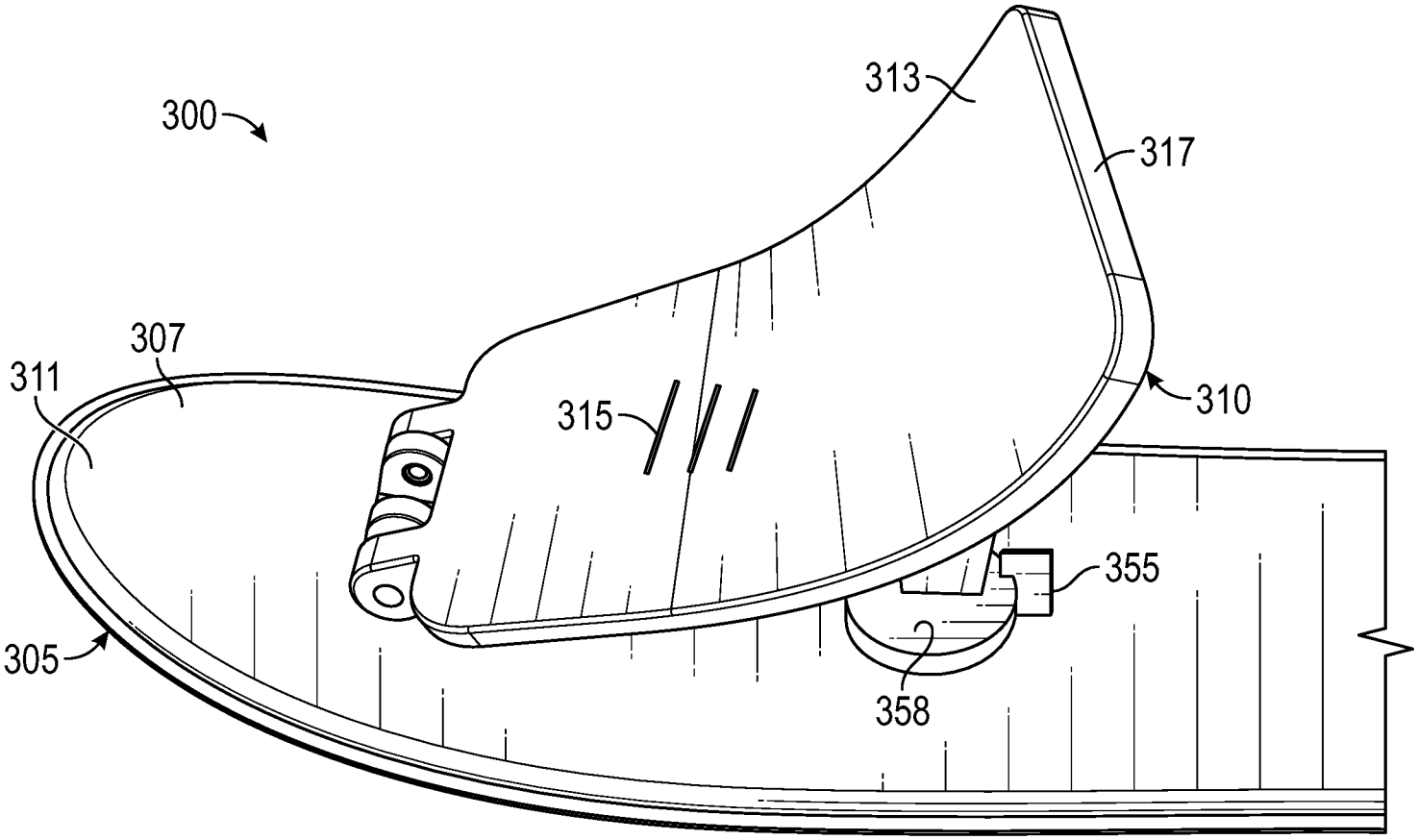
FIG. 3 is a perspective view of a snow displacement apparatus, according to an embodiment.

FIG. 3 is a perspective view of a snow displacement apparatus 300, according to an embodiment. The snow displacement apparatus 300 may include a deflector 310 with a curved front surface 313 that varies in curvature along its length transitioning from a gradual curvature near a first point at a lower portion of the deflector 310 to a steeper curvature towards an upper portion of the deflector 310. Additionally, the curvature may gradually increase near a first point at a lower portion of the deflector 310 and then quickly transition to a steeper incline. This variation in curvature may provide several advantages. For instance, the gradual change in curvature may optimize the aerodynamic profile of the deflector 310. The section of the curved surface near a tip 311 of the ski 305, where the slope is less steep, may streamline airflow around any attachments in this area, such as a mounting bracket, which in turn reduces drag. This configuration may therefore improve the skier's performance by reducing resistance and allowing for smoother maneuvers through the snow. Additionally, as the curvature of the curved front surface 313 steepens towards the top rim 317 of the deflector 310, the steeper curvature of the curved front surface 313 allows the deflector 310 to effectively capture and lift a significant volume of snow, resulting in visually appealing clouds or "rooster tails" in front or behind the skier. This upward scooping action of creating snow clouds enhances the aesthetic quality of skiing photographs and adds to the exhilarating experience of skiing in deep powder conditions.

The front curved surface 313 may include a hydrophobic or water-repellent coating 315 to facilitate more efficient shedding of snow from the deflector 310 and to prevent clumping. Several examples of suitable coatings include fluoropolymer coatings (e.g., PTFE, Teflon), silicone-based coatings, polyurethane coatings, nano-coatings, ceramic coatings, wax-based coatings, perfluorinated compounds (PFCs), polymer-based coatings, acrylic coatings, oleophobic coatings (repels oils as well as water), and the like.

The snow displacement apparatus 300 may include a limiting component or stopper 355. The stopper 355 may be inserted so that it positions over a circular foam attachment 358 at the rear end of the snow displacement apparatus 300, which contacts the top surface 307 of the ski. As the snow displacement apparatus 300 rotates, it cannot rotate above the height of the stopper above the foam attachment 358. In another embodiment, the stopper 355 may be positioned near a pivot point or hinge where the deflector 310 is attached to the front end of the ski 305. The stopper 355 may prevent excessive forward rotation of the deflector 310 beyond a predetermined angle forward or rearward to avoid obstructing ski movement and potential tripping hazards for the skier. The stopper's location may be chosen based on the deflector's configuration and desired range of motion during skiing to allow sufficient rotation for effective snow displacement while maintaining skier safety. For instance, in one embodiment, the stopper 355 may be integrated with the mounting component or detachable fastener. In another embodiment, the stopper 355 may be a separate component attached to the top surface 107 of the ski 105 near a mounting component.

Suitable examples of stoppers for the deflector 310 include adjustable mechanical stoppers or electronic limit switches. Adjustable mechanical stoppers may be physical components that can be attached to either the ski or the deflector 310 itself. They may include screws, bolts, or pins that can be adjusted to set the maximum forward rotation angle. These stoppers may provide flexibility and ease of adjustment to accommodate different skiing conditions and user preferences. On the other hand, electronic limit switches are sensors integrated into the apparatus that detect the position of the deflector. When the deflector 310 reaches the predetermined angle of rotation, the limit switch may send a signal to the control circuit to stop further rotation. Electronic limit switches may provide precise control and can be programmed to adjust the stopping angle as needed. Both types of stoppers may prevent excessive forward rotation of the deflector 310.

Figure 4:
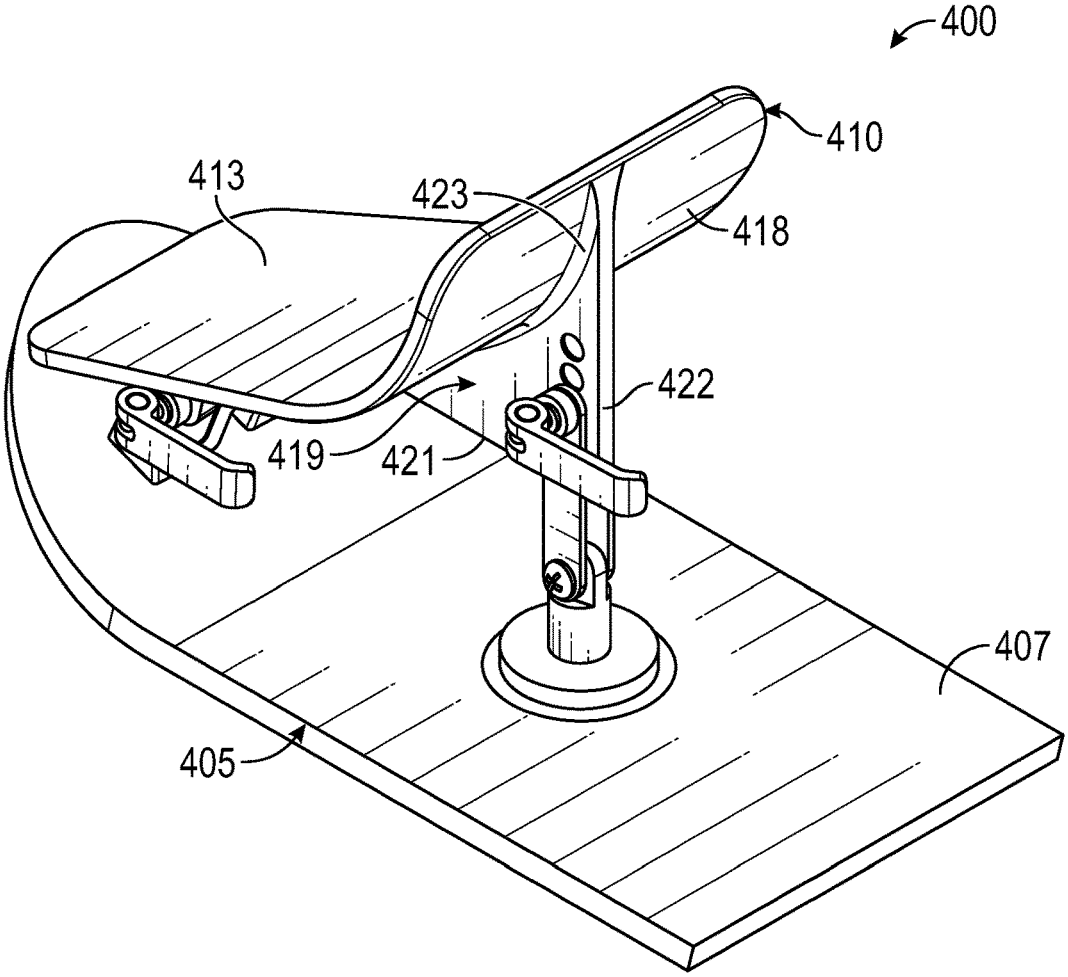
FIG. 4 is a perspective rear view of a snow displacement apparatus, according to an embodiment.

FIG. 4 is a perspective rear view of a snow displacement apparatus 400, according to an embodiment. On a surface 418 opposite a front-facing surface 413 of the deflector 410, there may be a support structure or component 419 extending from the rear or back of the deflector 410 down towards a top surface 407 of a ski 405. In an embodiment, the support component 419 may be polygonal-shaped and can have straight or curved sides and angles, including triangles, as well as shapes with more than three sides, such as rectangles, pentagons, or hexagons. For example, in the embodiment shown in this figure, a curvilinear triangular-shaped component may be integrated into the back of the deflector 410. The curvilinear triangular-shaped component may include a first edge 421, a second edge 422, and a third edge 423. The third edge 423 of the curvilinear triangular-shaped component may be integrated into the back side of the deflector 410, contouring the curved shape of the deflector 410. In the embodiment shown in this figure, the polygonal-shaped component may be integrated into the rear of the deflector 410 in a manner that forms a single integrated component. In another embodiment, the polygonal-shaped component may be a separate component attached to the rear of the deflector 410. Additionally, variations of polygonal shapes, such as irregular polygons, rhombuses, or trapezoids, may also be utilized depending on design preferences and functional requirements. The polygonal-shaped components may serve various purposes, such as reinforcing the structural integrity of the deflector 410 or providing attachment points for additional accessories.

Figure 5:
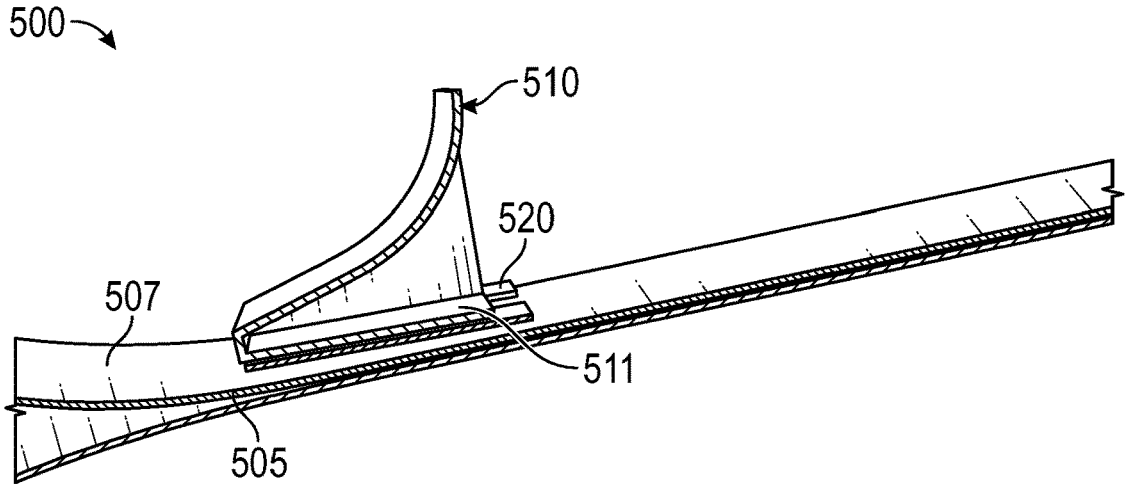
FIG. 5 is a side view of a snow displacement apparatus, according to an embodiment.

FIG. 5 is a side view of a snow displacement apparatus 500, according to an embodiment. The snow displacement apparatus 500 may include a deflector 510 configured to capture and displace powder snow during skiing maneuvers. The deflector 510 may be connected to a top surface 507 of a ski 505 via a mounting component 520. In this embodiment, the deflector includes a base surface 511, while the mounting component 520 may include rails, a plate, or an adhesive affixed to the top surface 507 of the ski 505. The base surface 511 of the deflector 510 may be directly coupled to the plate. In one embodiment, the plate may be attached to the ski's top surface 505, and the deflector 510 may be connected to the plate via one of the coupling components described, such as two points of contact. Alternatively, in another embodiment, the base surface may be substantially flat, and the flat surface may be directly attached to the plate using screws or similar fasteners. In yet another embodiment, the plate may be integrally connected to the ski within a receptacle cavity, such that the plate is integrally coupled to the ski 505 within the receptacle cavity of the ski and is flush with the top surface 507 of the ski 505.

The plate within the ski 505 may be configured to rotate upward from its cavity, allowing it to pivot along with the integrated deflector 510. This may permit the plate to pivot outward and retract into the ski 505 when not in use. A hinged coupling mechanism within the ski may be included within the cavity to enable this movement. As the plate rotates upward, it emerges from the recess or contour within the ski, extending to its operational position for deflecting snow. Conversely, when the skier opts not to use it, the plate can be retracted back into the cavity by simply unlocking it and pushing it back into place.

Additionally, within the receptacle cavity, bearings or bushings may be incorporated to minimize friction during rotation. To secure the plate in its desired position, a locking mechanism can be integrated into the hinge coupling, allowing the skier to quickly rotate and lock the plate as needed. This component may enable easy adjustment and reliable locking of the plate's position. The snow displacement apparatus 500 may further include a quick-release component positioned between the plate and the deflector's base surface 511. The quick-release component may be configured to detachably connect the base surface of the deflector for efficient detachment and reattachment of the deflector 510 to the mounting plate 520. Various quick-release components may be utilized for this purpose. For example, the quick-release component may include a rail system that enables sliding attachment along a rail on the base surface, corresponding to a groove or track on the plate. Alternatively, the quick-release component may include a lever latch mechanism that allows for quick and secure fastening or unfastening with a simple lever action. Similarly, the quick-release component may include a toggle clamp that provides rapid attachment and release through a toggle lever mechanism. Additionally, the quick-release component may include a spring-loaded pin system that provides secure attachment via spring-loaded pins inserted into corresponding holes on the base surface 511 and the plate, released with the press of a button or cam lock mechanisms that tighten or loosen the connection using a rotating cam lever for efficient attachment and detachment. Furthermore, the quick-release component may include magnetic quick-release components utilizing magnets embedded within the base surface 511 and the plate for a strong yet easily detachable connection.

In an embodiment, the snow displacement apparatus 500 may be integrated as a single unit with the ski 505, where it can be extended outward and retracted back in to the ski 505. Additionally, mounting brackets, such as plates, threaded studs, or the brackets themselves, can be integrated and molded into the ski during the manufacturing process. Integrating mounting brackets into the ski during manufacturing streamlines the assembly process and may eliminate the need for separate attachments or modifications post-production.

Figure 6:
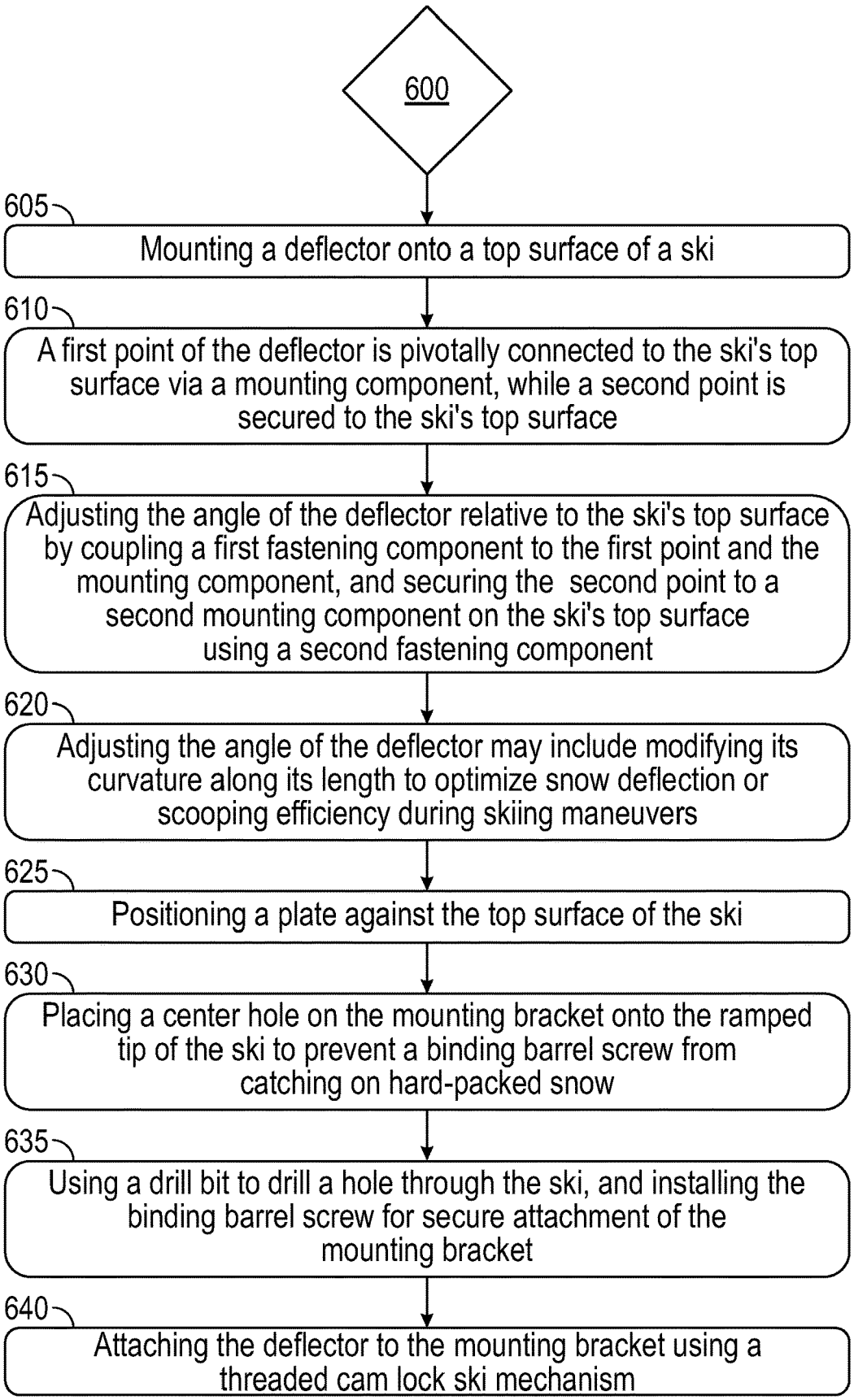
FIG. 6 illustrates a flow diagram of a method for utilizing a snow displacement apparatus, according to an embodiment.

FIG. 6 illustrates a flow diagram outlining a method (600) for utilizing the snow displacement apparatus described in the subject application, according to an embodiment. Initially, the method may include mounting a deflector onto a top surface of a ski (605). A first point of the deflector may be pivotally connected to the ski's top surface via a mounting component, while a second point is secured to the ski's top surface (610). The method may also include adjusting the angle of the deflector relative to the ski's top surface by coupling a first fastening component to the first point and the mounting component, and securing the second point to a second mounting component on the ski's top surface using a second fastening component (615). To optimize snow deflection or scooping efficiency during skiing maneuvers, adjusting the angle of the deflector may include modifying its curvature along its length (620).

Next, the snow displacement apparatus may be positioned so that a plate is positioned against the top surface of the ski (625). The method may include placing a center hole on the mounting bracket onto the ramped tip of the ski to prevent a binding barrel screw from catching on hard-packed snow (630). Adhesive tape backing may be removed from the mounting bracket and securely affixed to the ski, as is the plate to the ski's flat top surface.

Continuing, a drill bit may be used to drill a hole through the ski, and the binding barrel screw may be installed to ensure the secure attachment of the mounting bracket (635). The deflector may then be attached to the mounting bracket using a threaded cam lock ski mechanism (640).

Skiing maneuvers may be performed to effectively capture and displace powder snow. When the snow displacement apparatus is no longer needed, the cam locks are undone, and the attachment is removed, or conveniently stored in a backpack for future use if skiing conditions do not warrant its use. Moreover, the deflector may be detachably connected to the mounting bracket using a detachable fastener. This method serves as an example, with many variations and embodiments available for the disclosed apparatus's use.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e, methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. An apparatus, comprising:

a deflector configured to capture and displace snow during a skiing maneuver, wherein:

a first contact point of the deflector is pivotally connected to a top surface of a ski proximate a front end of the ski via a mounting component;

a second contact point of the deflector is in contact with the top surface of the ski; and the deflector comprises a curved front surface having a contoured profile, wherein:

the curved front surface extends upwardly from the first contact point towards the second contact point; and the curved front surface curves upwardly proximate the second contact point; and a detachable fastener configured to detachably and rotatably couple the first contact point of the deflector to the mounting component, wherein an angle of the deflector relative to the top surface of the ski is adjustable.

2. The apparatus of claim 1, wherein:

the detachable fastener comprises a locking component; and the locking component is configured to lock the deflector in place at an angle when in a locked position and enable the deflector to rotate freely when in an unlocked position.

3. The apparatus of claim 2, wherein the locking component comprises a cam lock.

4. The apparatus of claim 1, wherein:

the apparatus further comprises a limiting component coupled to the mounting component or adjacent to the mounting component on the ski; and the limiting component is configured to prevent the deflector from rotating beyond a predetermined angle forward or rearward.

5. The apparatus of claim 4, wherein:

the deflector is constructed from a heat-resistant material; and the heat-resistant material comprises carbon fiber, fiberglass, ceramic, or a heat-resistant plastic.

6. The apparatus of claim 1, further comprising:

a sensor configured to detect a ski movement;

a control circuit configured to operably control a heating element integrated within the deflector, wherein the heating element is configured to apply heat to the front curved surface of the deflector based on input from the sensor; and a battery for supplying power to the heating element.

7. The apparatus of claim 1, wherein the contoured profile comprises a J-shaped configuration.

8. An apparatus, comprising:

a deflector configured to capture and displace powder snow during a skiing maneuver, wherein:

the deflector comprises a curved front surface having a contoured profile, wherein:

the curved front surface extends upwardly from the first contact point towards the second contact point; and the curved front surface curves upwardly proximate the second contact point; and the deflector is coupled to a top surface of a ski via a mounting component; and a detachable fastener for detachably coupling the deflector to the mounting component.

9. The apparatus of claim 8, wherein:

the curved front surface comprises a hydrophobic or water-repellent coating;

the hydrophobic or water-repellent coating comprises a fluoropolymer coating, silicone-based coating, polyurethane coating, nano-coating, ceramic coatings, wax-based coating, perfluorinated compound (PFC) coating, polymer-based coating, acrylic coating, or oleophobic coating.

10. The apparatus of claim 8, wherein:

the deflector is positioned at an angle relative to the top surface of the ski that is fixed or adjustable; and if the angle is adjustable, the apparatus further comprises a locking component for adjusting the angle of the deflector relative to the top surface of the ski.

11. The apparatus of claim 8, wherein:

the mounting component is positionally coupled on a substantially flat portion of a top surface of the ski adjacent to a tip of the ski as the tip begins to curve; and a fastening component is flush with a substantially flat portion of a bottom surface of the ski.

12. The apparatus of claim 8, wherein:

the deflector comprises a base surface;

the mounting component comprises a plate coupled to the top surface of the ski; and the base surface of the deflector is coupled to the plate.

13. The apparatus of claim 12, wherein the plate is integrally coupled to the ski within a receptacle cavity of the ski and is flush with the top surface of the ski.

14. The apparatus of claim 12, further comprising a quick-release component for detachably coupling the base surface of the deflector to the plate.

15. The apparatus of claim 14, wherein the quick-release component comprises a rail, lever latch, toggle clamp, spring-loaded pin, cam lock, or magnetic quick-release component.

16. A method, comprising:

mounting a deflector onto a top surface of a ski, wherein:

a first point of the deflector is pivotally connected to the ski via a mounting component;

a second point of the deflector is in contact with the top surface of the ski; and the deflector comprises a curved front surface having a contoured profile, wherein:

the curved front surface extends upwardly from the first contact point towards the second contact point; and the curved front surface curves upwardly proximate the second contact point;

coupling a first fastening component to the first point of the deflector and the mounting component;

adjusting an angle of the deflector relative to the top surface of the ski by rotating the deflector to a desired angle; and locking the deflector at the desired angle using a locking component.

17. The method of claim 16, wherein:

the deflector is constructed from a pliable material configured to hold its shape until the pliable material is bent again; and the pliable material comprises polypropylene or polyethylene.

18. The method of claim 16, further comprising detachably connecting the second point of the deflector to a magnetic mount coupled to the top surface of the ski using a detachable fastener, wherein the magnetic mount is affixed to the top surface of the ski using an adhesive.

19. The method of claim 16, further comprising adjusting a curvature of a front curved surface of the deflector by bending it, wherein an adjustment of the curvature of the front curved surface corresponds to altering the angle at which snow is captured and displaced during a skiing maneuver.

20. The method of claim 16, wherein adjusting the angle of the deflector comprises adjusting the angle of the deflector by an actuator based on a signal received from a control circuit.

* * * * *